US009745968B2

(12) United States Patent
Kotapish et al.

(10) Patent No.: US 9,745,968 B2
(45) Date of Patent: Aug. 29, 2017

(54) MANIFOLD INCLUDING MOUNTING PLATE FOR FLUID END BLOCK OF RECIPROCATING PUMP ASSEMBLY

(71) Applicant: S.P.M. Flow Control, Inc., Fort Worth, TX (US)

(72) Inventors: Ed Kotapish, Willow Park, TX (US); Chad Cobb, Joshua, TX (US)

(73) Assignee: S.P.M. FLOW CONTROL, INC., Fort Worth, TX (US)

( * ) Notice: Subject to any disclaimer, the term of this patent is extended or adjusted under 35 U.S.C. 154(b) by 141 days.

(21) Appl. No.: 14/679,151

(22) Filed: Apr. 6, 2015

(65) Prior Publication Data

US 2015/0300332 A1 Oct. 22, 2015

Related U.S. Application Data

(60) Provisional application No. 61/976,353, filed on Apr. 7, 2014.

(51) Int. Cl.
*F04B 53/16* (2006.01)
*F04B 53/22* (2006.01)
(Continued)

(52) U.S. Cl.
CPC ..... *F04B 1/12* (2013.01); *F04B 39/0094* (2013.01); *F04B 39/14* (2013.01); *F04B 53/006* (2013.01);
(Continued)

(58) Field of Classification Search
CPC ..... F04B 53/007; F04B 53/16; F04B 53/22
(Continued)

(56) References Cited

U.S. PATENT DOCUMENTS 2,873,227 A 2/1959 Olson et al.
3,373,695 A * 3/1968 Yohpe ..... F04B 1/00 417/454

(Continued)

FOREIGN PATENT DOCUMENTS

CN 201753815 3/2011
GB 968347 A 9/1964

OTHER PUBLICATIONS

"Extended European Search Report dated Nov. 13, 2015 re Application No. 13741018.9, 8 pages."

(Continued)

*Primary Examiner* — Peter J Bertheaud
(74) *Attorney, Agent, or Firm* — Haynes and Boone LLP

(57) ABSTRACT

In one aspect, a fluid end portion of a reciprocating pump assembly includes a fluid end block and an inlet manifold connected thereto. The manifold includes an opening formed therethrough and including a slot portion to facilitate the connection between the inlet manifold and the fluid end block. In another aspect, a method of connecting an inlet manifold to a fluid end block includes inserting fasteners into respective openings in the fluid end block, and effecting relative movement between the inlet manifold and the fluid end block so that the fasteners pass within respective slot portions formed through a mounting plate of the inlet manifold. In yet another aspect, a manifold is adapted to be connected to a fluid end block and includes an elongated member and a mounting plate connected thereto. The mounting plate includes openings formed therethrough, the openings including respective slot portions spaced in a parallel relation.

21 Claims, 12 Drawing Sheets

(51) Int. Cl.

| | |
|---|---|
| ***F04B 1/12*** | (2006.01) |
| ***F04B 39/00*** | (2006.01) |
| ***F04B 39/14*** | (2006.01) |
| ***F04B 53/14*** | (2006.01) |
| ***F04B 53/00*** | (2006.01) |

(52) U.S. Cl.
CPC ..... *F04B 53/14* (2013.01); *F04B 53/16* (2013.01); *F04B 53/22* (2013.01)

(58) Field of Classification Search
USPC ..... 417/454, 539, 568
See application file for complete search history.

(56) References Cited

U.S. PATENT DOCUMENTS

| | | | | |
|---|---|---|---|---|
| 3,437,467 | A | 4/1969 | Floyd | |
| 3,799,196 | A | 3/1974 | Scheitlin et al. | |
| 4,349,403 | A | 9/1982 | Blenner et al. | |
| 4,712,578 | A | 12/1987 | White | |
| 4,886,009 | A | 12/1989 | Gondar et al. | |
| 4,922,958 | A | 5/1990 | Lemp | |
| 5,823,093 | A | 10/1998 | Kugelev et al. | |
| 5,860,452 | A | 1/1999 | Ellis | |
| 5,950,575 | A | 9/1999 | Simons et al. | |
| 6,089,837 | A | 7/2000 | Cornell | |
| 6,109,304 | A | 8/2000 | Wolf et al. | |
| 6,651,698 | B1 | 11/2003 | Wilkes | |
| 7,252,071 | B2 | 8/2007 | Kochanowski et al. | |
| 7,278,837 | B2 | 10/2007 | Malmberg et al. | |
| 7,354,256 | B1 | 4/2008 | Cummins | |
| 7,524,173 | B2 | 4/2009 | Cummins | |
| 7,621,728 | B2 * | 11/2009 | Miller | F04B 53/16 417/454 |
| 8,105,055 | B2 * | 1/2012 | Small | F04B 53/16 403/321 |
| 8,444,398 | B2 * | 5/2013 | Brunet | F04B 47/02 137/15.18 |
| 8,899,940 | B2 * | 12/2014 | Leugemors | F04B 43/02 137/207 |
| 9,441,776 | B2 * | 9/2016 | Byrne | F04B 11/0008 |
| 2002/0108660 | A1 | 8/2002 | Braun et al. | |
| 2005/0248334 | A1 | 11/2005 | Dagenais et al. | |
| 2005/0276708 | A1 | 12/2005 | Miller et al. | |
| 2006/0225705 | A1 | 10/2006 | Kochanowski et al. | |
| 2008/0276998 | A1 | 11/2008 | Boyher et al. | |
| 2010/0068508 | A1 | 3/2010 | Shinde et al. | |
| 2011/0110793 | A1 | 5/2011 | Leugemors et al. | |
| 2012/0024413 | A1 | 2/2012 | Yang et al. | |
| 2013/0071256 | A1 | 3/2013 | Kent | |
| 2014/0137963 | A1 | 5/2014 | Blume | |
| 2014/0251486 | A1 | 9/2014 | Gunsing | |
| 2016/0341347 | A1 | 11/2016 | Byrne et al. | |
| 2016/0369926 | A1 | 12/2016 | Shuck | |

OTHER PUBLICATIONS

"First Chinese Office Action dated Dec. 2, 2015 re Chinese Application No. 201380016207.1, 26 pages."
"International Preliminary Report on Patentability by the IPEA/US, dated Jan. 14, 2014, re PCT/US2013/022938, 6 pages."
"International Search Report and Written Opinion for PCT/US2013/022938, dated Mar. 29, 2013, 9 pages."
"International Search Report and Written Opinion for PCT/US2016/038474, dated Oct. 5, 2016, 9 pages."
"Notice of Allowance dated May 3, 2016 in U.S. Appl. No. 13/749,025, 8 pages."
"Office Action dated Aug. 31, 2015 in U.S. Appl. No. 13/749,025, 25 pages."
"Office Action dated Feb. 11, 2016 in U.S. Appl. No. 13/749,025, 25 pages."
"Office Action dated Mar. 30, 2015 in U.S. Appl. No. 13/749,025, 7 pages."

* cited by examiner

MANIFOLD INCLUDING MOUNTING PLATE FOR FLUID END BLOCK OF RECIPROCATING PUMP ASSEMBLY

CROSS-REFERENCE TO RELATED APPLICATION

This application claims the benefit of the filing date of, and priority to, U.S. patent application No. 61/976,353, filed Apr. 7, 2014, the entire disclosure of which is hereby incorporated herein by reference.

TECHNICAL FIELD

This disclosure relates in general to pump assemblies and, in particular, a reciprocating pump assembly that includes a fluid end block and a manifold.

BACKGROUND OF THE DISCLOSURE

A reciprocating pump assembly may include a fluid end block and an inlet manifold connected thereto. The fluid end block and the inlet manifold may have corresponding mounting-hole bolt patterns. Time consuming and/or labor intensive efforts may be made to sufficiently align the mounting-hole bolt patterns and connect the inlet manifold to the fluid end block using the aligned mounting-hole bolt patterns. Therefore, what is needed is an apparatus or method that addresses this issue, and/or other issues.

SUMMARY

In a first aspect, there is provided a fluid end portion of a reciprocating pump assembly, the fluid end portion being adapted to be operably coupled to a power end portion of the reciprocating pump assembly. The fluid end portion includes a fluid end block including a bottom surface and a first plurality of openings formed in the bottom surface; an inlet manifold connected to the fluid end block, the inlet manifold including a mounting plate mated against the bottom surface of the fluid end block, the mounting plate including a second plurality of openings formed therethrough and generally aligned with the first plurality of openings, respectively, wherein a first opening in the second plurality of openings includes a first slot portion to facilitate the connection between the inlet manifold and the fluid end block; and a plurality of fasteners connecting the inlet manifold to the fluid end block, each of the fasteners extending: through a respective one of the openings in the second plurality of openings and thus through the mounting plate, and into a respective one of the openings in the first plurality of openings that is generally aligned with the one opening in the second plurality of openings through which the fastener extends. A first fastener in the plurality of fasteners extends through the first slot portion of the first opening in the second plurality of openings.

In an exemplary embodiment, the first opening further includes a first arcuate portion through which the first fastener extends.

In another exemplary embodiment, the first arcuate portion is part of the first slot portion.

In yet another exemplary embodiment, the first opening further includes a first notch portion formed in an edge of the mounting plate, and the first slot portion extends from the first notch portion to the first arcuate portion.

In certain exemplary embodiments, a second opening in the first plurality of openings includes: a second notch portion formed in the edge of the mounting plate, a second slot portion extending from the second notch portion, and a second arcuate portion to which the second slot portion extends. A second fastener in the plurality of fasteners extends through the second slot portion and the second arcuate portion of the second opening in the second plurality of openings.

In an exemplary embodiment, the mounting plate includes opposing lead-in chamfers adapted to guide the first fastener into the first slot portion, the opposing lead-in chamfers being defined by the first notch portion of the first opening.

In another exemplary embodiment, the first opening further includes a first notch portion formed in an edge of the mounting plate. The first slot portion extends from the first notch portion.

In yet another exemplary embodiment, the first fastener is adapted to pass within the first slot portion during relative movement between the inlet manifold and the fluid end block.

In a second aspect, there is provided a method of connecting an inlet manifold to a fluid end block of a reciprocating pump assembly. The method includes inserting first and second fasteners into respective openings in a first plurality of openings formed in the fluid end block; effecting relative movement between the inlet manifold and the fluid end block so that the first and second fasteners pass within first and second slot portions, respectively, formed through a mounting plate of the inlet manifold; continuing to effect relative movement between the inlet manifold and the fluid end block so that the first and second fasteners pass within the first and second slot portions, respectively, until a second plurality of openings formed through the mounting plate are generally aligned with the first plurality of openings formed in the fluid end block, wherein first and second openings in the second plurality of openings include the first and second slot portions, respectively; and connecting the inlet manifold to the fluid end block using at least the first and second fasteners.

In an exemplary embodiment, effecting relative movement between the inlet manifold and the fluid end block so that the first and second fasteners pass within the first and second slot portions, respectively, includes passing the first and second fasteners through first and second notch portions formed in an edge of the mounting plate, wherein the first and second slot portions extend from the first and second notch portions, respectively.

In another exemplary embodiment, the first and second notch portions define first and second pairs of opposing lead-in chamfers, respectively. During the relative movement between the inlet manifold and the fluid end block, the first and second pairs of opposing lead-in chamfers are adapted to guide the first and second fasteners, respectively, to the first and second slot portions, respectively.

In yet another exemplary embodiment, the second plurality of openings are generally aligned with the first plurality of openings formed in the fluid end block when the first and second fasteners contact or nearly contact first and second arcuate edges of the mounting plate, and wherein the first and second arcuate edges are defined by first and second arcuate portions, respectively, which are formed through the mounting plate.

In certain exemplary embodiments, the first and second arcuate portions are part of the first and second slot portions, respectively.

In an exemplary embodiment, the first and second slot portions extend to the first and second arcuate portions, respectively.

In another exemplary embodiment, the method includes inserting additional fasteners through respective openings in the second plurality of openings and into respective openings in the first plurality of openings that are generally aligned therewith. Connecting the inlet manifold to the fluid end block using at least the first and second fasteners includes connecting the inlet manifold to the fluid end block using at least the first fastener, the second fastener, and the additional fasteners.

In a third aspect, there is provided a manifold adapted to be connected to a fluid end block of a reciprocating pump assembly, the fluid end block including a first plurality of openings formed therein. The manifold includes an elongated member defining a fluid passage; and a mounting plate connected to the elongated member, the mounting plate including a second plurality of openings formed therethrough and adapted to be generally aligned with the first plurality of openings, respectively, to connect the manifold to the fluid end block. The second plurality of openings includes first and second openings, the first and second openings including first and second slot portions, respectively, the first and second slot portions being spaced in a parallel relation.

In an exemplary embodiment, the first and second openings further include first and second notch portions, respectively, which are formed in an edge of the mounting plate and from which the first and second slot portions extend, respectively.

In another exemplary embodiment, the first and second notch portions define first and second pairs of opposing lead-in chamfers, respectively.

In yet another exemplary embodiment, the first and second openings further include first and second arcuate portions, respectively. The first and second arcuate portions are adapted to be generally aligned with respective openings in the first plurality of openings to connect the manifold to the fluid end block.

In certain exemplary embodiments, the first and second arcuate portions are part of the first and second slot portions, respectively.

In an exemplary embodiment, the first and second slot portions extend to the first and second arcuate portions, respectively.

Other aspects, features, and advantages will become apparent from the following detailed description when taken in conjunction with the accompanying drawings, which are a part of this disclosure and which illustrate, by way of example, principles of the inventions disclosed.

DESCRIPTION OF FIGURES

The accompanying drawings facilitate an understanding of the various embodiments.

DETAILED DESCRIPTION

Figure 1:
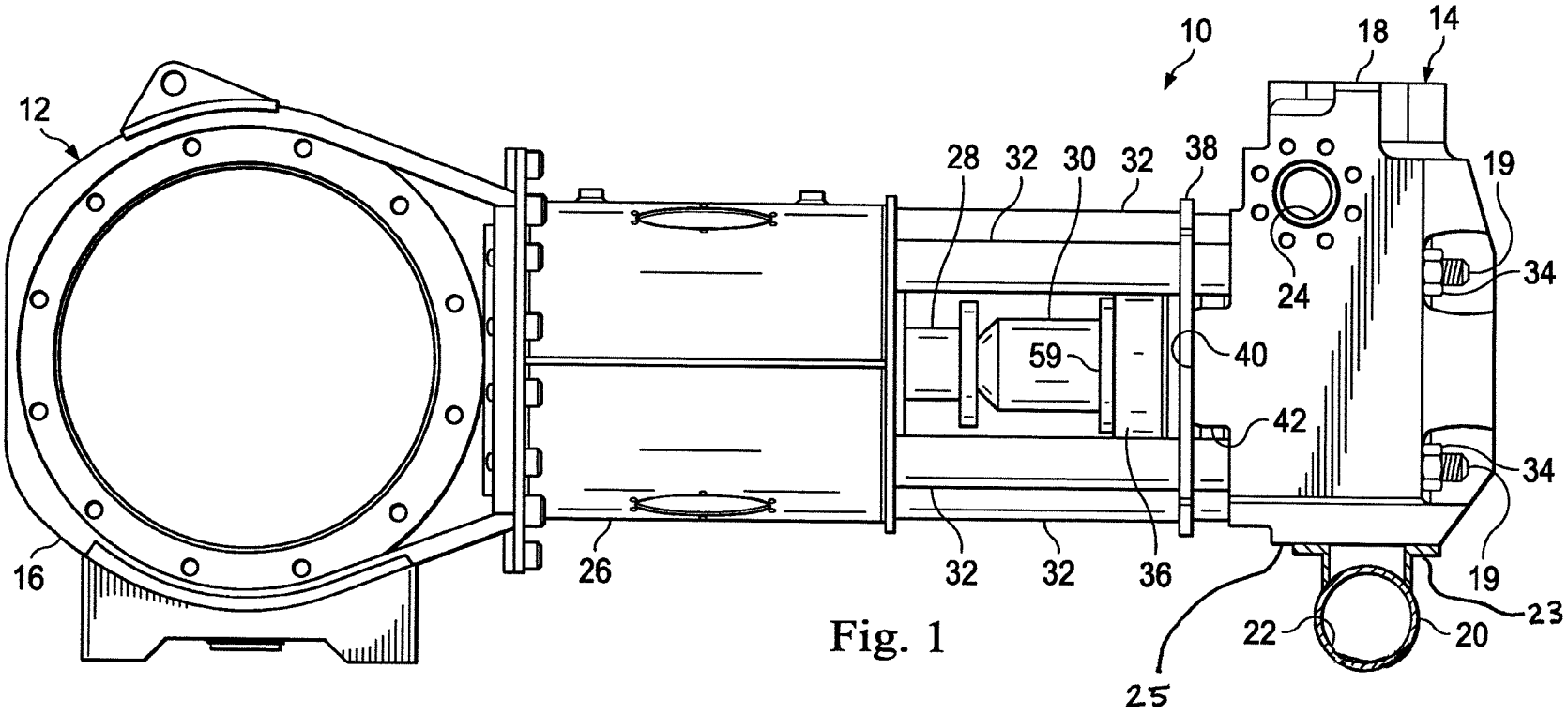
FIG. 1 is an elevational view of a reciprocating pump assembly according to an exemplary embodiment, the reciprocating pump assembly including a suction, or inlet, manifold, and a fluid end block.

In an exemplary embodiment, as illustrated in FIG. 1, a reciprocating pump assembly is generally referred to by the reference numeral 10 and includes a power end portion 12 and a fluid end portion 14 operably coupled thereto. The power end portion 12 includes a crankshaft housing 16 in which a crankshaft (not shown) in disposed, the crankshaft being operably coupled to an engine or motor (not shown), which is adapted to drive the crankshaft. The fluid end portion 14 includes a fluid end block 18, which is connected to the crankshaft housing 16 via a plurality of stay rods 19, two of which are shown in FIG. 1. A suction, or inlet, manifold 20 is connected to the fluid end block 18 and includes a fluid inlet passage 22 and a mounting plate 23. The fluid end block 18 includes a fluid outlet passage 24, which is spaced in a parallel relation from the fluid inlet passage 22 of the inlet manifold 20. The fluid end block 18 includes a plurality of pressure chambers (not shown) formed therein so that each pressure chamber is in fluid communication with each of the fluid inlet passage 22 and the fluid outlet passage 24. The mounting plate 23 of the inlet manifold 20 mates against a bottom surface 25 of the fluid end block 18.

A stationary crosshead housing 26 is connected to the crankshaft housing 16. In several exemplary embodiments, the stationary crosshead housing 26 is part of the crankshaft housing 16. A plurality of pony rods 28 extend out of the stationary crosshead housing 26. A plurality of plungers 30 are connected to the pony rods 28, respectively. One of the pony rods 28, and the corresponding plunger 30 connected thereto, are shown in FIG. 1. A plurality of sleeves 32 (four shown in FIG. 1) extend between the stationary crosshead housing 26 and the fluid end block 18. The stay rods 19 extend from at least the crankshaft housing 16, through the stationary crosshead housing 26, through respective ones of the sleeves 32, and through respective bores (not shown) formed in the fluid end block 18. The stay rods 19 include respective threaded ends, which are threadably engaged with respective nuts 34 to connect the fluid end block 18 to the crankshaft housing 16.

The fluid end block 18 further includes a plurality of integrally formed bosses 36 (one shown in FIG. 1) which protrude towards the crankshaft housing 16. A nose plate, or an alignment plate 38, is engaged with a surface 40 of the fluid end block 18. The surface 40 is defined by an integrally formed web 42 of the fluid end block 18, from which the bosses 36 protrude. The sleeves 32 extend through the alignment plate 38 and engage the fluid end block 18.

In several exemplary embodiments, each of the bosses 36 may be characterized as, or may be a part of, a packing gland. Since the bosses 36 are integrally formed with the fluid end block 18, each of the bosses 36 may be characterized as, or may be a part of, an integrated packing gland. In an exemplary embodiment, instead of being integrally formed with the fluid end block 18, each of the bosses 36 may be connected to the fluid end block 18 using fasteners such as, for example, bolts. In an exemplary embodiment, instead of being integrally formed with the fluid end block 18, the bosses 36 and the web 42 may be connected to the fluid end block 18 using fasteners such as, for example, bolts.

In several exemplary embodiments, one or more of the stationary crosshead housing 26, the sleeves 32, and the alignment plate 38, and/or one or more other components, may be characterized as the "mid-section" of the reciprocating pump assembly 10, or the "mid-section power frame" of the reciprocating pump assembly 10.

During operation, in several exemplary embodiments, the power end portion 12 is adapted to cause the plungers 30, one of which is shown in FIG. 1, to reciprocate in and out of the pressure chambers, respectively, thereby causing fluid to be: sucked into the one or more of the pressure chambers via the fluid inlet passage 22; pressurized in the one or more of the pressure chambers; and discharged out of the fluid end block 18 via the fluid outlet passage 24. In several exemplary embodiments, the combination of at least each pressure chamber and corresponding plunger 30 may be characterized as a plunger throw. In several exemplary embodiments, the reciprocating pump assembly 10 includes one plunger throw, two plunger throws, or three plunger throws (i.e., a triplex pump that includes three bosses 36). In an exemplary embodiment, the reciprocating pump assembly 10 includes five plunger throws and thus may be a quintuplex, or quint, pump that includes five bosses 36. Alternatively, the reciprocating pump assembly 10 includes four, or more than five, plunger throws.

In an exemplary embodiment, the reciprocating pump assembly 10 is a pump configured to conduct cementing and/or acidizing operations within an oil and gas well. In an exemplary embodiment, the reciprocating pump assembly 10 is a mud pump, or a hydraulic fracturing pump, which is configured to hydraulically fracture (or "frac") an oil and gas well. In an exemplary embodiment, the reciprocating pump assembly 10 is a pump suitable for performing high pressure fracing operations, and may be used to obtain pressures of about 15,000 psi or more. In an exemplary embodiment, the reciprocating pump assembly 10 is a pump suitable for performing high pressure fracing operations, and may be used to obtain pressures of less than about 15,000 psi.

Figure 3:
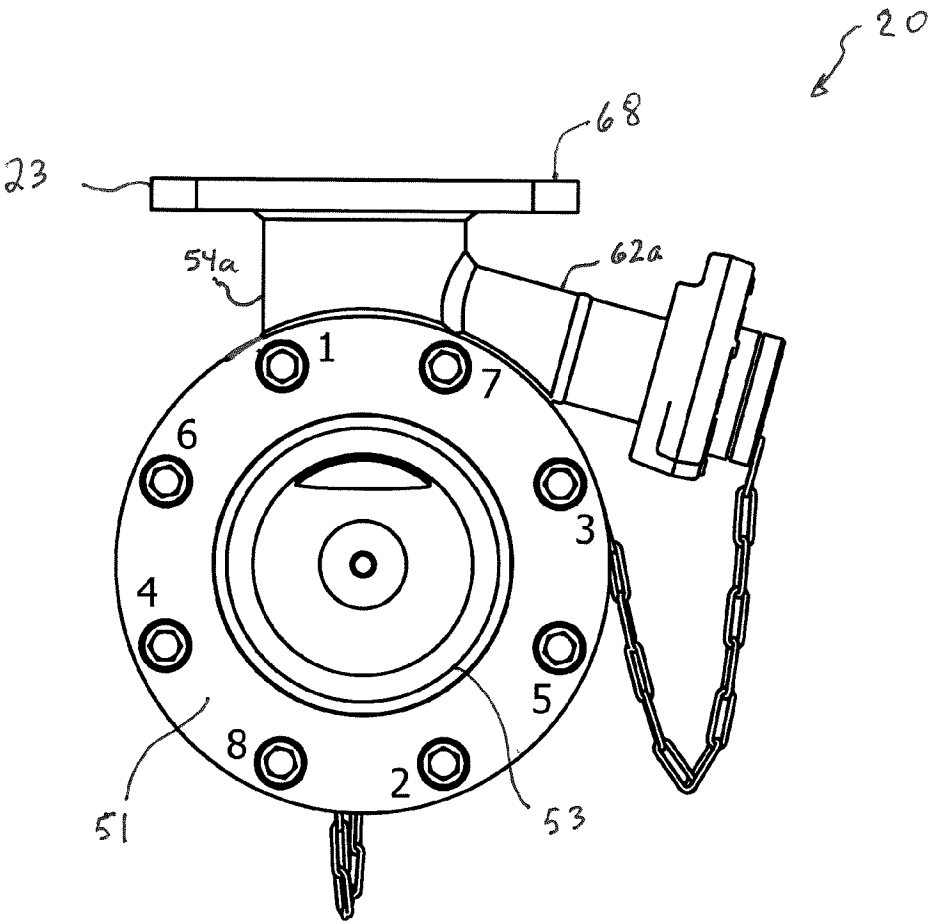
FIG. 3 is a left side elevational view of the inlet manifold of FIG. 2, according to an exemplary embodiment.
Figure 4:
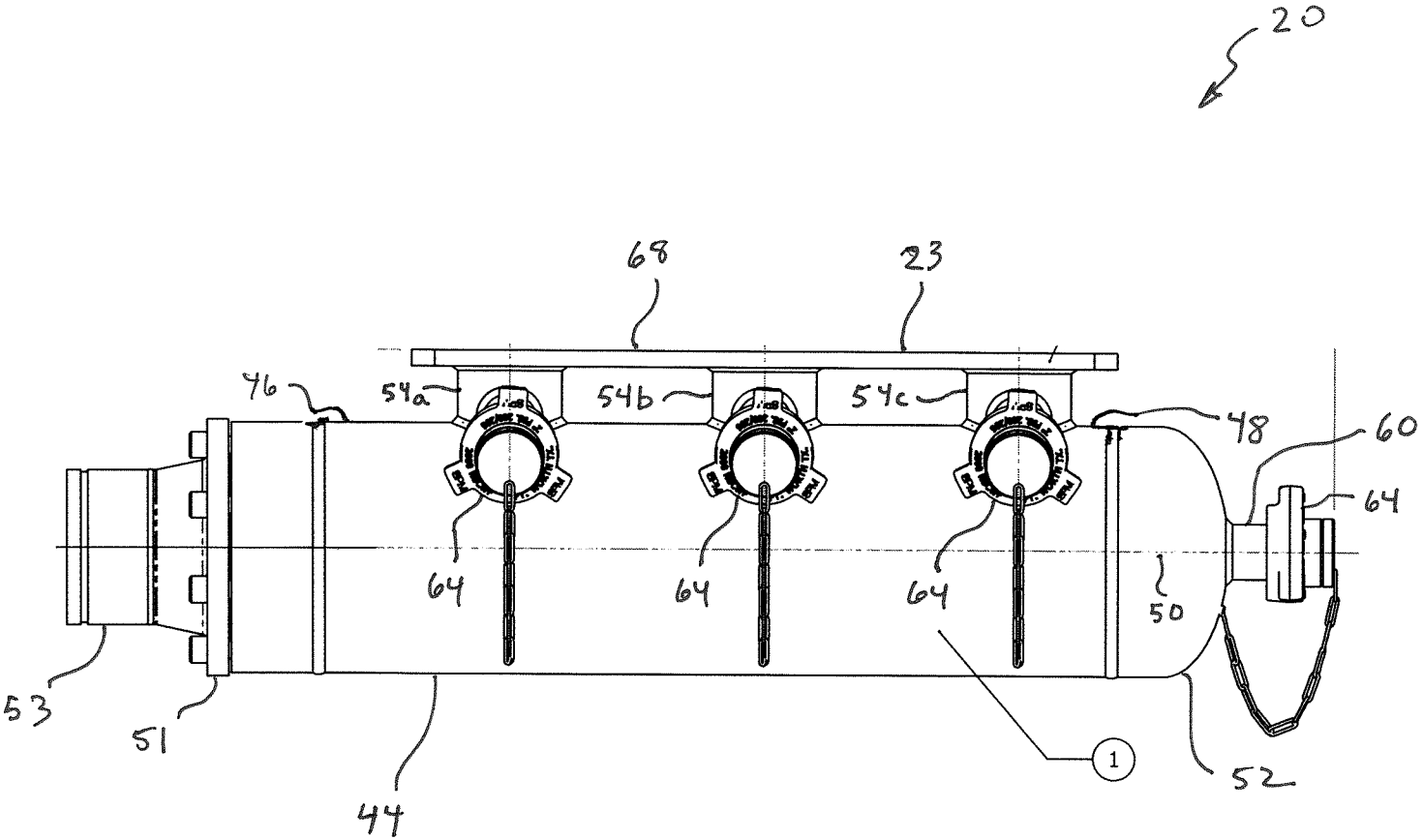
FIG. 4 is a front elevational view of the inlet manifold of FIGS. 2 and 3, according to an exemplary embodiment.
Figure 5:
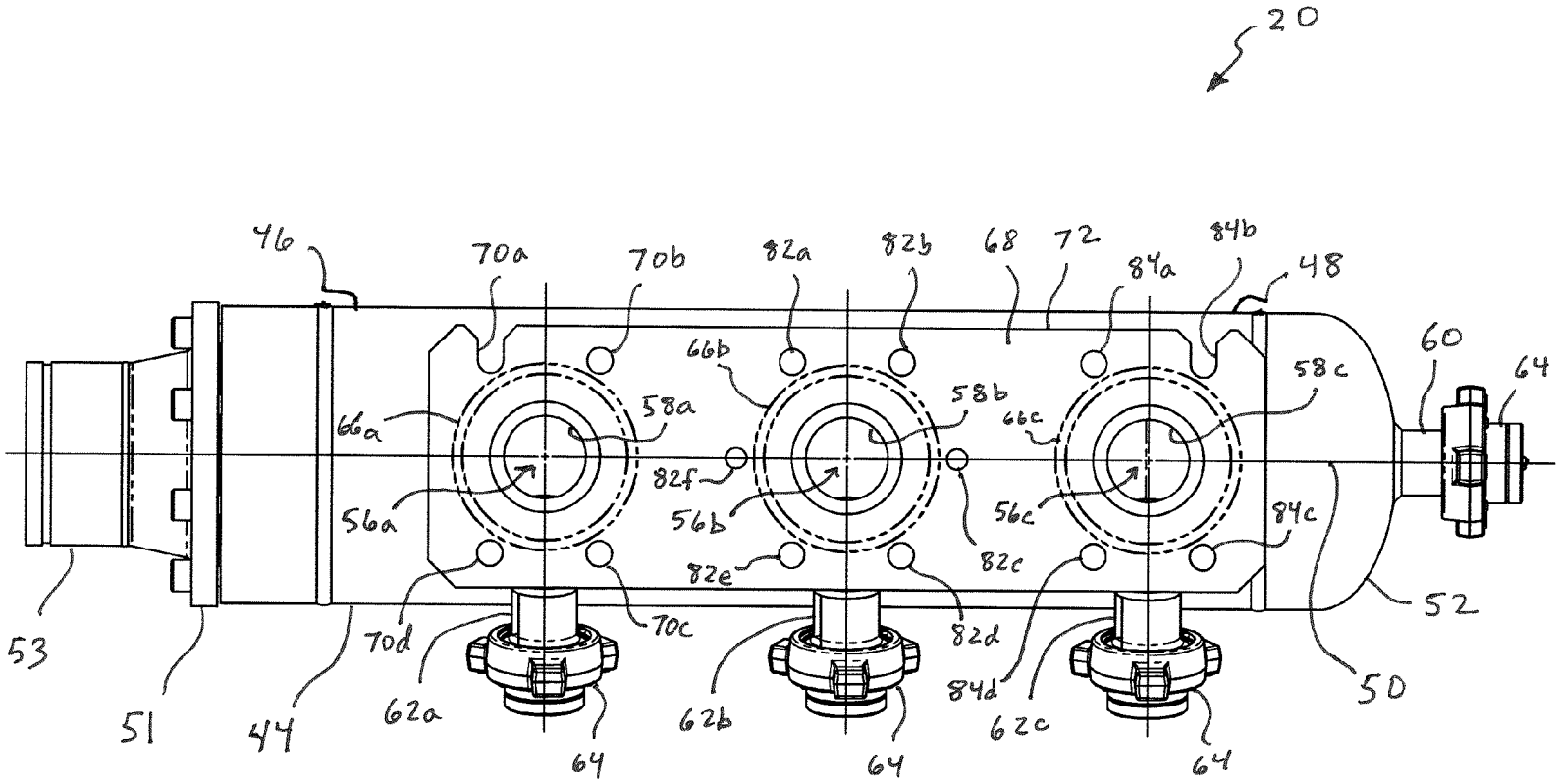
FIG. 5 is a top plan view of the inlet manifold of FIGS. 2-4, according to an exemplary embodiment.

In an exemplary embodiment, as illustrated in FIGS. 2-5 with continuing reference to FIG. 1, the inlet manifold 20 includes an elongated member 44 that is generally cylindrical and includes opposing end portions 46 and 48. A longitudinal axis 50 is defined by the elongated member 44. An end plate 51 is connected to the elongated member 44 at the end portion 46, and an end cap 52 is connected to the elongated member 44 at the end portion 48. A connector 53 extends from the end plate 51, and is adapted to be connected to a fluid conduit. Axially-spaced tubes 54*a*, 54*b*, and 54*c* extend from the elongated member 44 in a direction that is perpendicular to the longitudinal axis 50. The tubes 54*a*, 54*b*, and 54*c* define fluid passages 56*a*, 56*b*, and 56*c*, respectively (FIG. 5). The tubes 54*a*, 54*b*, and 54*c* extend to the mounting plate 23. Through-openings 58*a*, 58*b*, and 58*c* are formed through the mounting plate 23, and are in fluid communication with the fluid passages 56*a*, 56*b*, and 56*c*, respectively.

A cleanout stem 60 extends from the end cap 52 and along the longitudinal axis 50. Valve lift stems 62*a*, 62*b*, and 62*c* extend from the tubes 54*a*, 54*b*, and 54*c*, respectively. Respective bull plug assemblies 64 are connected to each of the cleanout stem 60 and the valve lift stems 62*a*, 62*b*, and 62*c*.

Annular channels 66*a*, 66*b*, and 66*c* are formed in a top surface 68 of the mounting plate 23. The annular channels 66*a*, 66*b*, and 66*c* extend circumferentially around the through-openings 58*a*, 58*b*, and 58*c*. Respective annular sealing elements (not shown) are adapted to extend within the annular channels 66*a*, 66*b*, and 66*c*, and sealingly engage the bottom surface 25 of the fluid end block 18 when the inlet manifold 20 is connected to the fluid end block 18.

Figure 2:
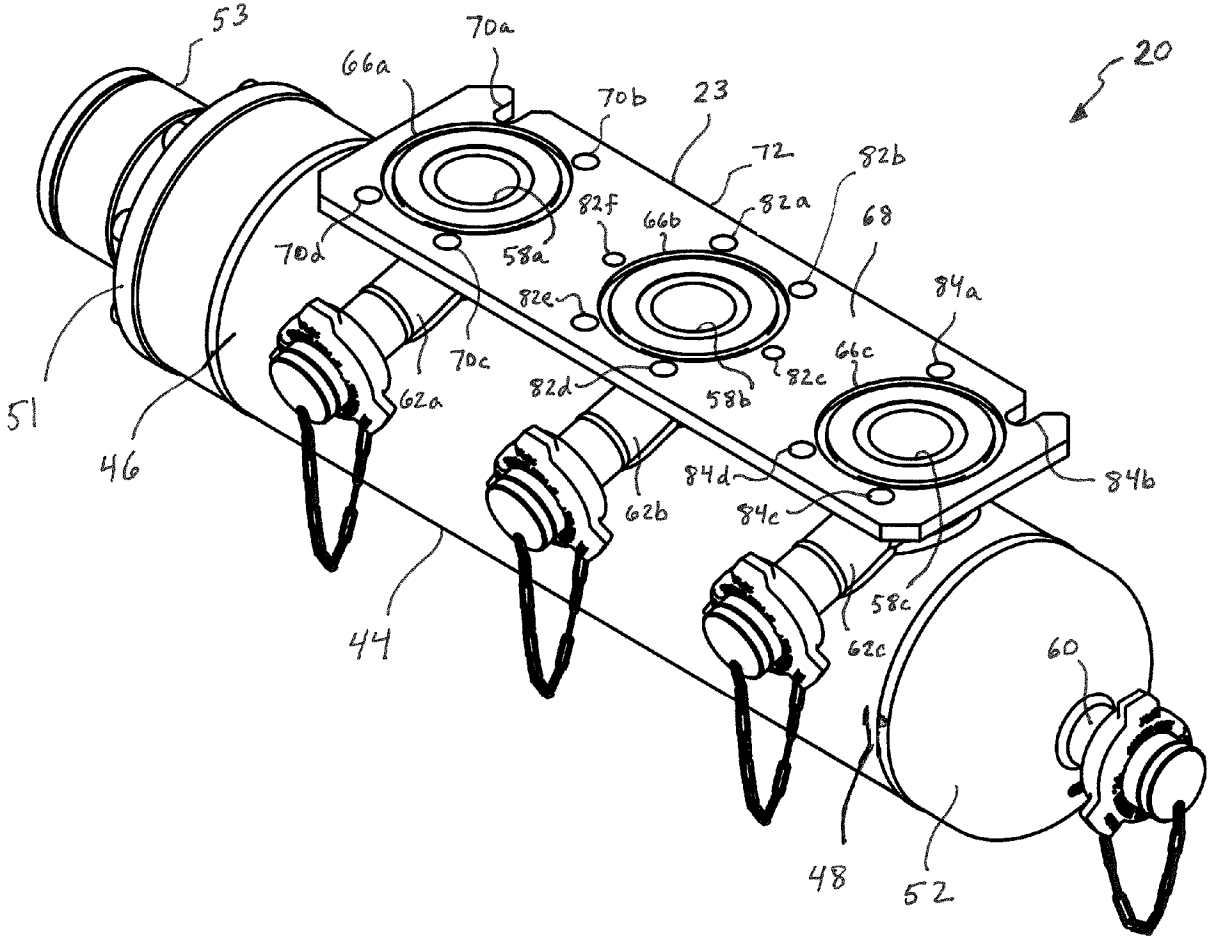
FIG. 2 is a perspective view of the inlet manifold of the reciprocating pump assembly of FIG. 1, according to an exemplary embodiment.
Figure 5A:
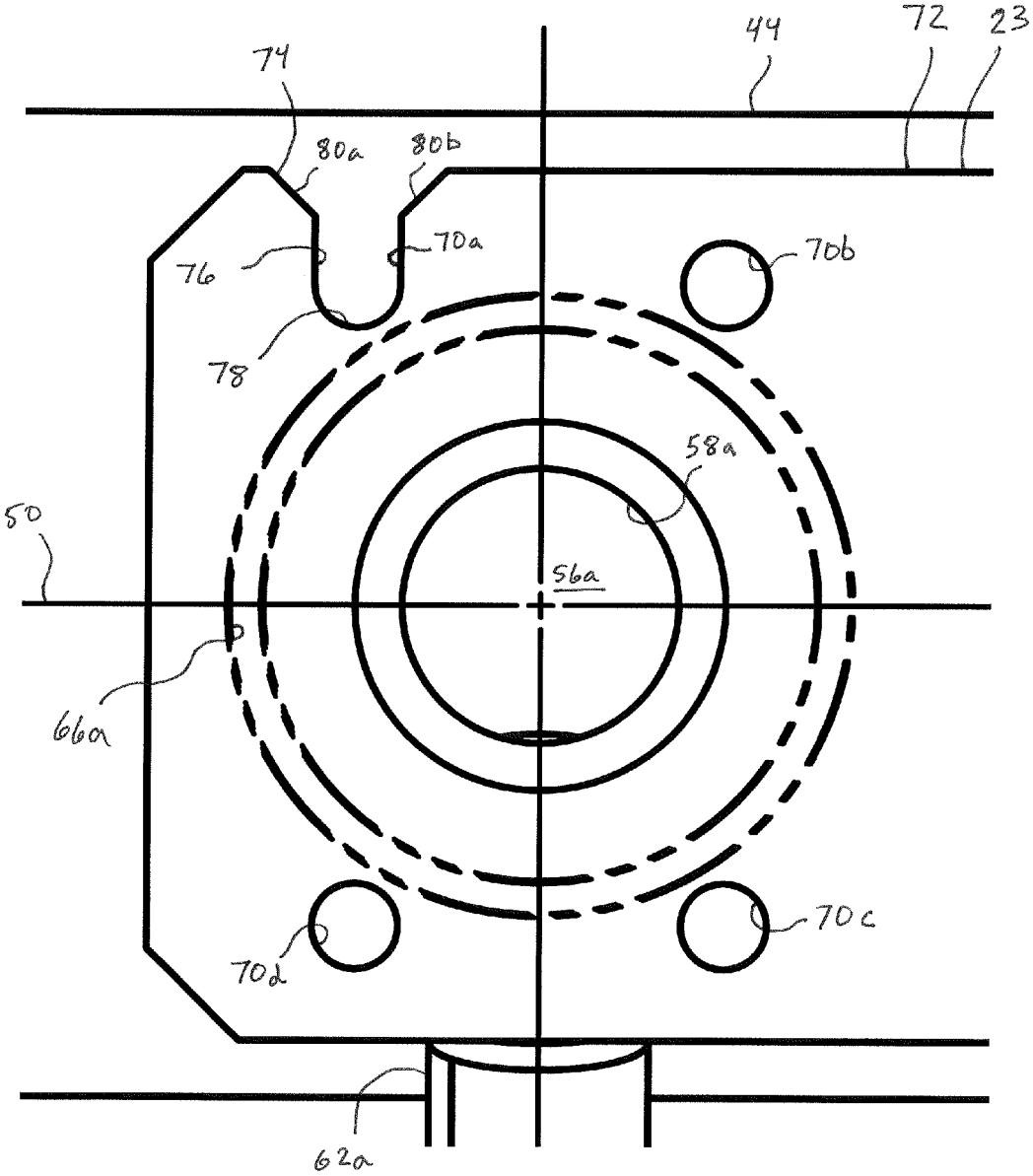
FIG. 5A is an enlarged view of a portion of FIG. 5, according to an exemplary embodiment.

In an exemplary embodiment, as illustrated in FIGS. 2, 5, and 5A with continuing reference to FIGS. 1, 3, and 4, through-openings 70*a*-70*d* are formed through the mounting plate 23, and are arranged around the through-opening 58*a*. As most clearly shown in FIG. 5A, the through-opening 70*a* includes a notch formed in an edge 72 of the mounting plate 23. In an exemplary embodiment, the through-opening 70*a* includes: a notch portion 74 formed in the edge 72; a slot portion 76 extending from the notch portion 74; and an arcuate portion 78 to which the slot portion 76 extends. The notch portion 74 defines opposing lead-in chamfers 80*a* and 80*b* of the mounting plate 23. In an exemplary embodiment, the arcuate portion 78 is part of the slot portion 76. In an exemplary embodiment, the through-opening 70*a* does not include the notch portion 74. In an exemplary embodiment, the slot portion 76 extends from the edge 72 to the arcuate portion 78. In contrast to the through-opening 70*a*, each of the through-openings 70*b*-70*d* is a hole formed through the mounting plate 23.

As shown in FIGS. 2 and 5, through-openings 82*a*-82*f* are formed through the mounting plate 23, and are arranged around the through-opening 58*b*. Each of the through-openings 82*a*-82*f* is a hole formed through the mounting plate 23.

Figure 5B:
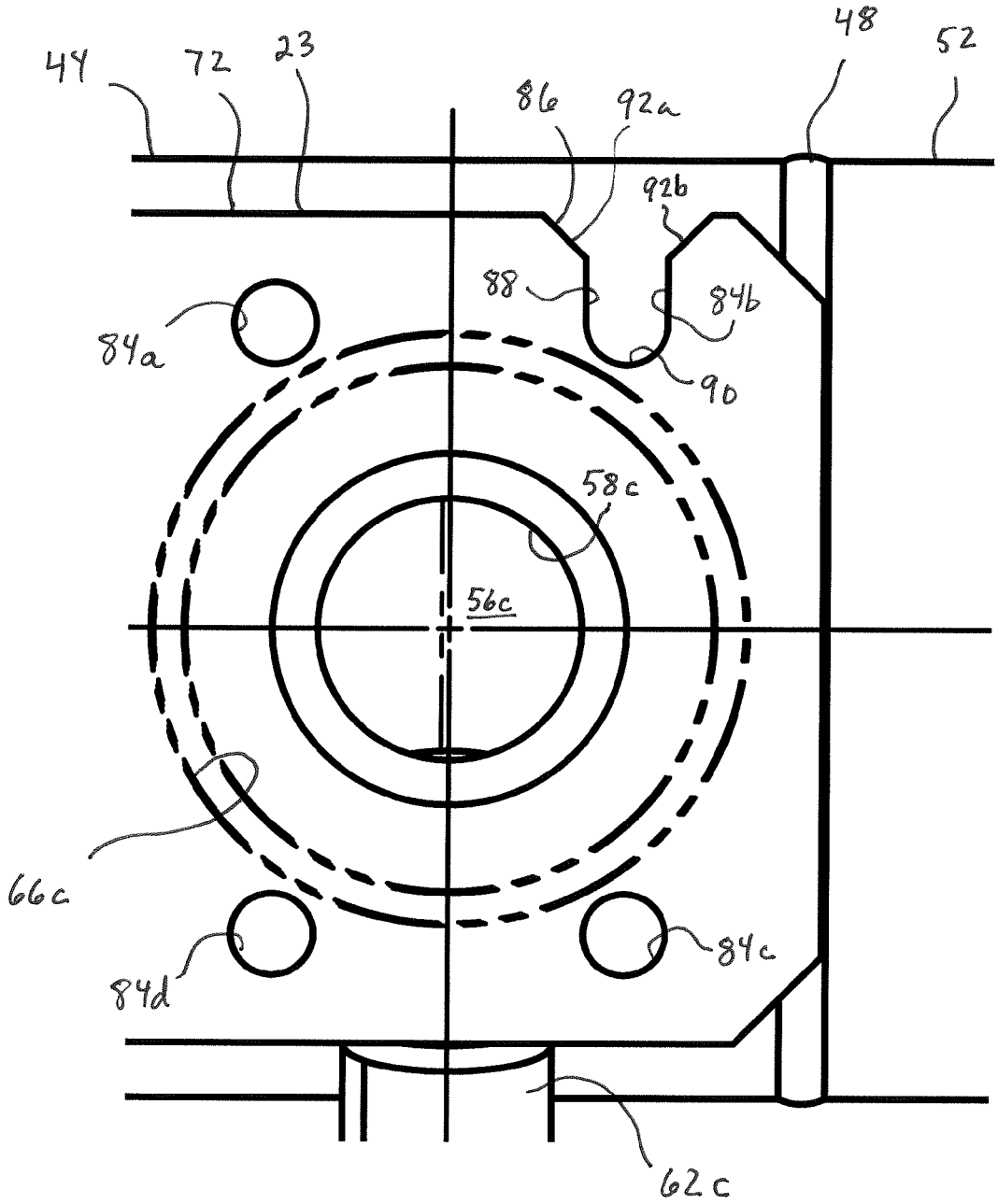
FIG. 5B is an enlarged view of another portion of FIG. 5, according to an exemplary embodiment.

In an exemplary embodiment, as illustrated in FIGS. 2, 5, and 5B with continuing reference to FIGS. 1, 3, 4, and 5A, through-openings 84*a*-84*d* are formed through the mounting plate 23, and are arranged around the through-opening 58*c*. Each of the through-openings 84*a*, 84*c*, and 84*d* is a hole formed through the mounting plate 23. In contrast, and as most clearly shown in FIG. 5B, the through-opening 84*b* includes a notch formed in the edge 72 of the mounting plate 23. In an exemplary embodiment, the through-opening 84*b* includes: a notch portion 86 formed in the edge 72; a slot portion 88 extending from the notch portion 86 and spaced in a parallel relation from the slot portion 76; and an arcuate portion 90 to which the slot portion 88 extends. The notch portion 86 defines opposing lead-in chamfers 92*a* and 92*b* of the mounting plate 23. In an exemplary embodiment, the arcuate portion 90 is part of the slot portion 88. In an exemplary embodiment, the through-opening 84*b* does not include the notch portion 86. In an exemplary embodiment, the slot portion 88 extends from the edge 72 to the arcuate portion 90.

Figure 6:
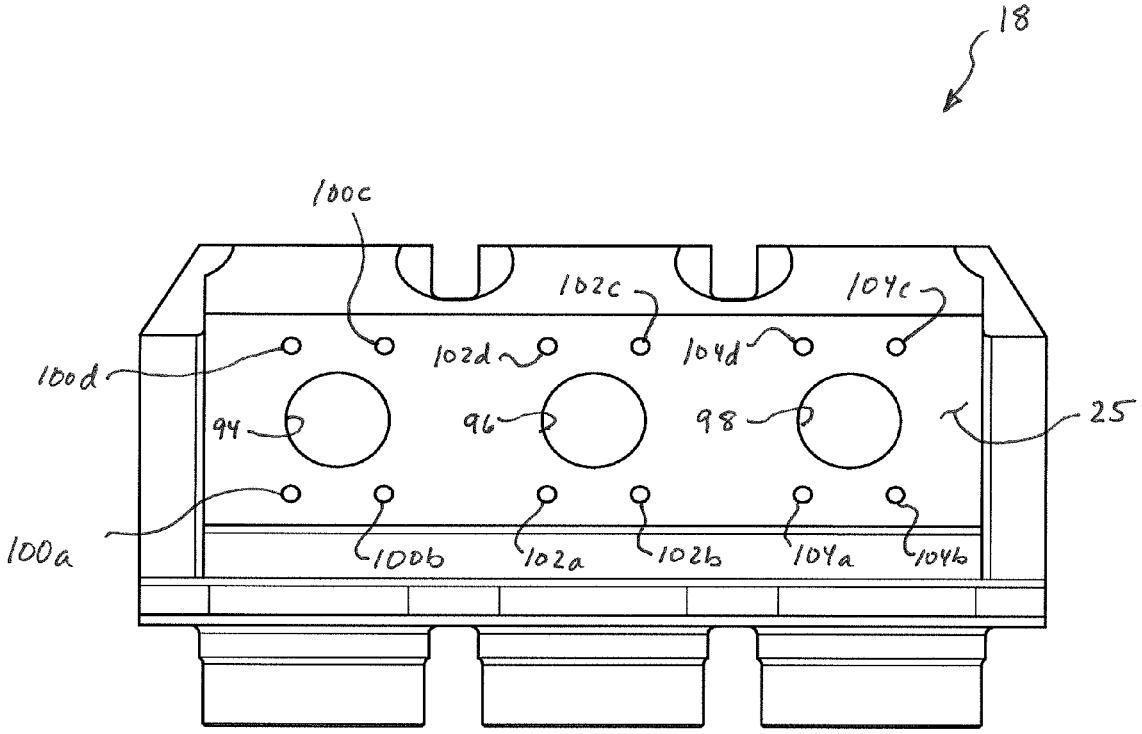
FIG. 6 is a bottom plan view of the fluid end block of the reciprocating pump assembly of FIG. 1, according to an exemplary embodiment.

In an exemplary embodiment, as illustrated in FIG. 6 with continuing reference to FIGS. 1-5B, the fluid end block 18 includes openings 94, 96, and 98, each of which is in fluid communication with a corresponding pressure chamber within the fluid end block 18 (not shown but described above in connection with FIG. 1). The openings 94, 96, and 98 are formed in the bottom surface 25 of the fluid end block 18. The arrangement of the openings 94, 96, and 98 in the fluid end block 18 corresponds to the arrangement of the openings 58*a*, 58*b*, and 58*c* in the mounting plate 23. Openings 100*a*-100*d* are formed in the bottom surface 25 of the fluid end block 18 and are arranged around the opening 94. Openings 102*a*-102*d* are formed in the bottom surface 25 of the fluid end block 18 and are arranged around the opening 96. Openings 104*a*-104*d* are formed in the bottom surface 25 of the fluid end block 18 and are arranged around the opening 98. In an exemplary embodiment, each of the openings 100*a*-100*d*, 102*a*-102*d*, and 104*a*-104*d* includes an internal threaded connection. In an exemplary embodiment, each of the openings 100*a*-100*d*, 102*a*-102*d*, and 104*a*-104*d* is a blind hole that includes an internal threaded connection.

In an exemplary embodiment, as illustrated in FIGS. 7A-8B with continuing reference to FIGS. 1-6, to connect the inlet manifold 20 to the fluid end block 18, fasteners, such as bolts 104*a* and 104*b*, are threadably engaged with the internal threaded connections of the openings 100*a* and 104*b*, respectively, of the fluid end block 18. The bolts 104*a* and 104*b* are screwed into the bottom surface 25 of the fluid end block 18 until there is a predetermined distance between the bottom surface 25 and the respective threaded sides of the bolt heads of the bolts 104*a* and 104*b*; in an exemplary embodiment, the predetermined distance is 1 inch, 1½ inches, or another distance.

The inlet manifold 20 is then positioned proximate the fluid end block 18, or offered up to the fluid end block 18. The inlet manifold 20 and the fluid end block 18 are positioned so that the mounting plate 23 of the inlet manifold 20 is vertically positioned, as viewed in FIG. 7A, between the bottom surface 25 of the fluid end block 18 and the respective threaded sides of the bolt heads of the bolts 104*a* and 104*b*. In several exemplary embodiments, the inlet manifold 20 and the fluid end block 18 are positioned so that the mounting plate 23 is positioned between the bottom surface 25 and the respective threaded sides of the bolt heads of the bolts 104*a* and 104*b* in a direction that is perpendicular to each of the respective directions indicated by arrows 106 and 108 in FIGS. 7A and 7B, as well as being perpendicular to the longitudinal axis 50 of the inlet manifold 20.

Figure 7A:
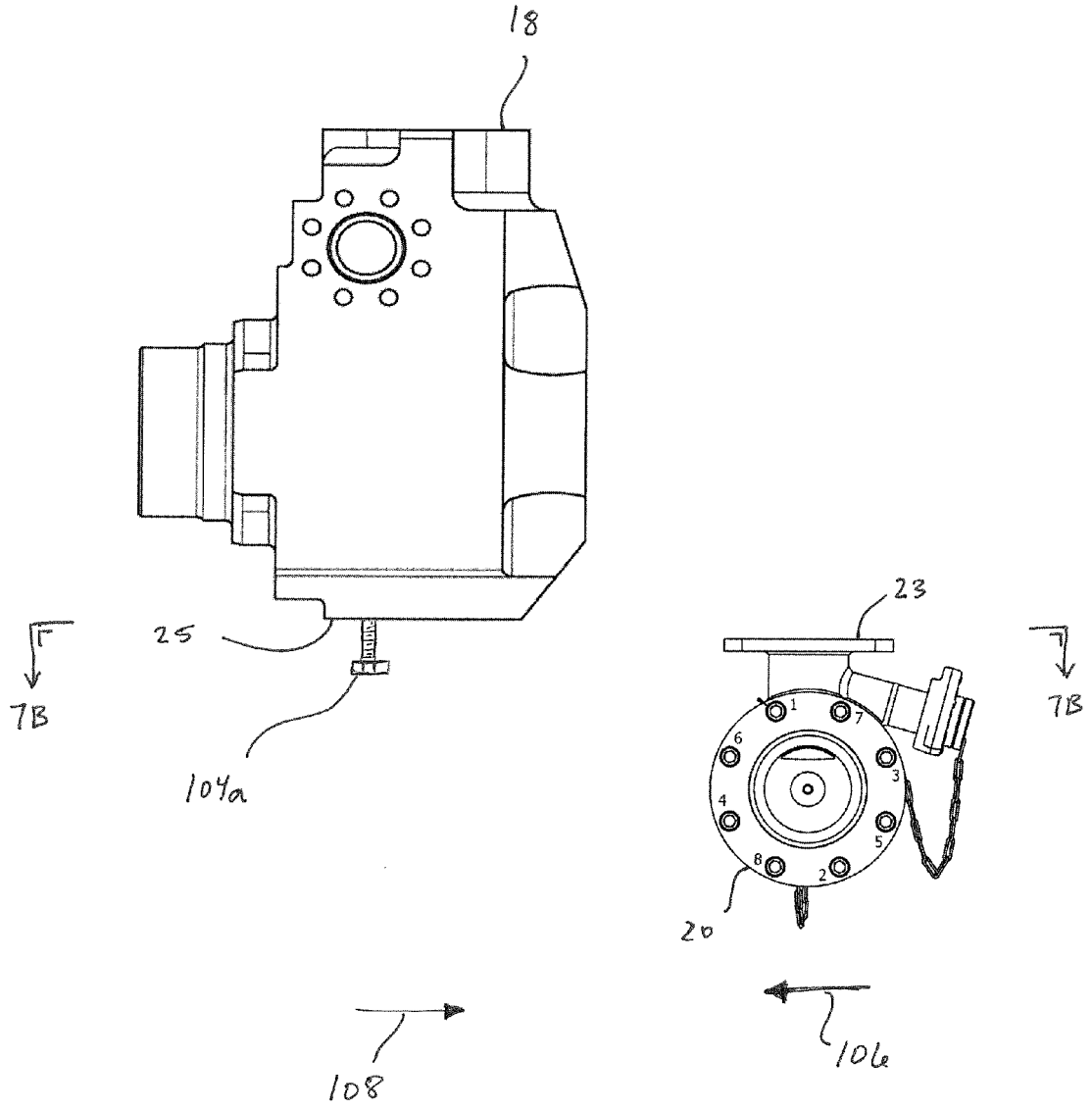
FIG. 7A is a side elevational view of the inlet manifold of FIGS. 2-5B being connected to the fluid end block of FIG. 6, according to an exemplary embodiment.
Figure 7B:
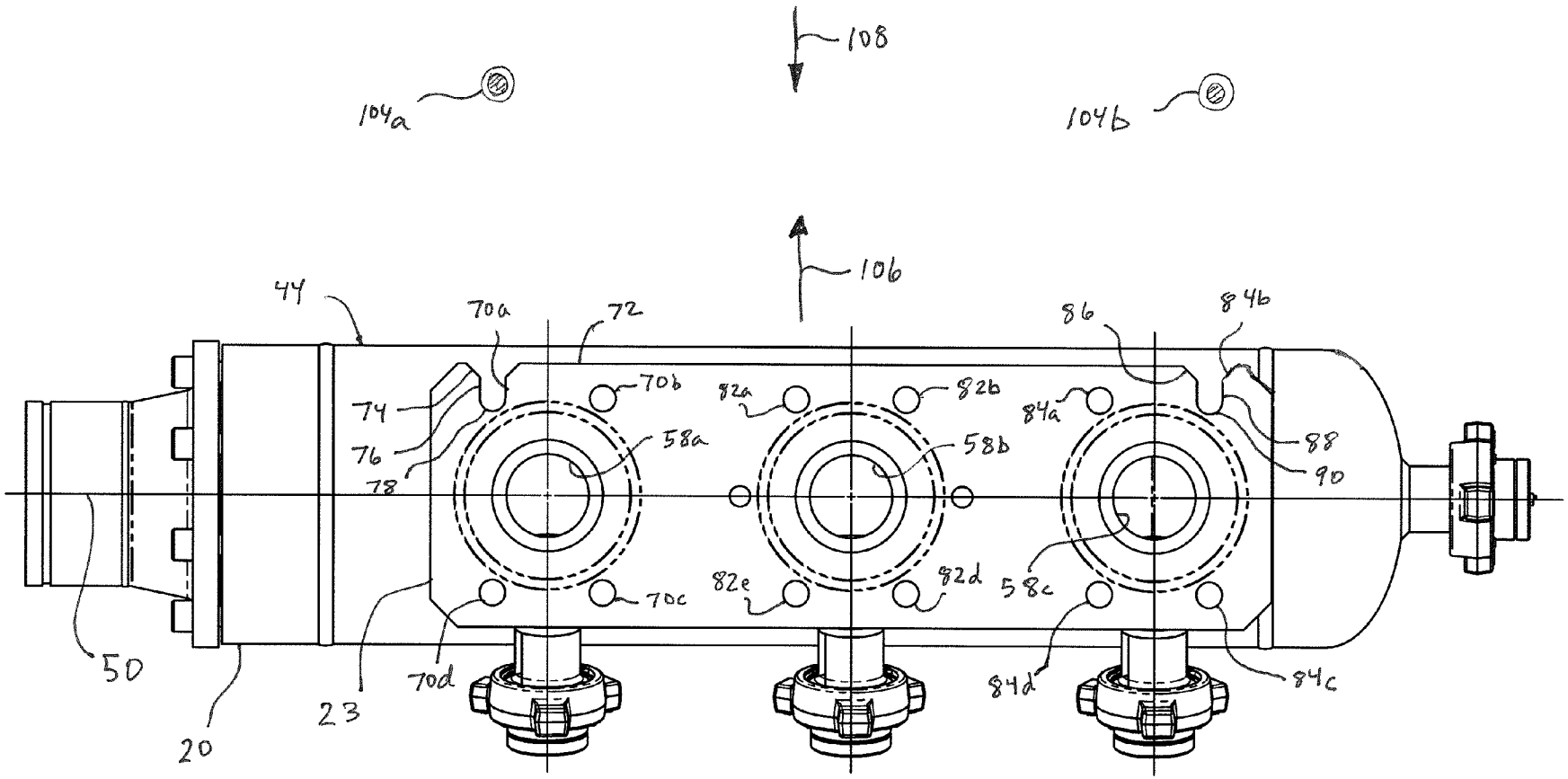
FIG. 7B is a sectional view taken along line 7B-7B of FIG. 7A, according to an exemplary embodiment.
Figure 8A:
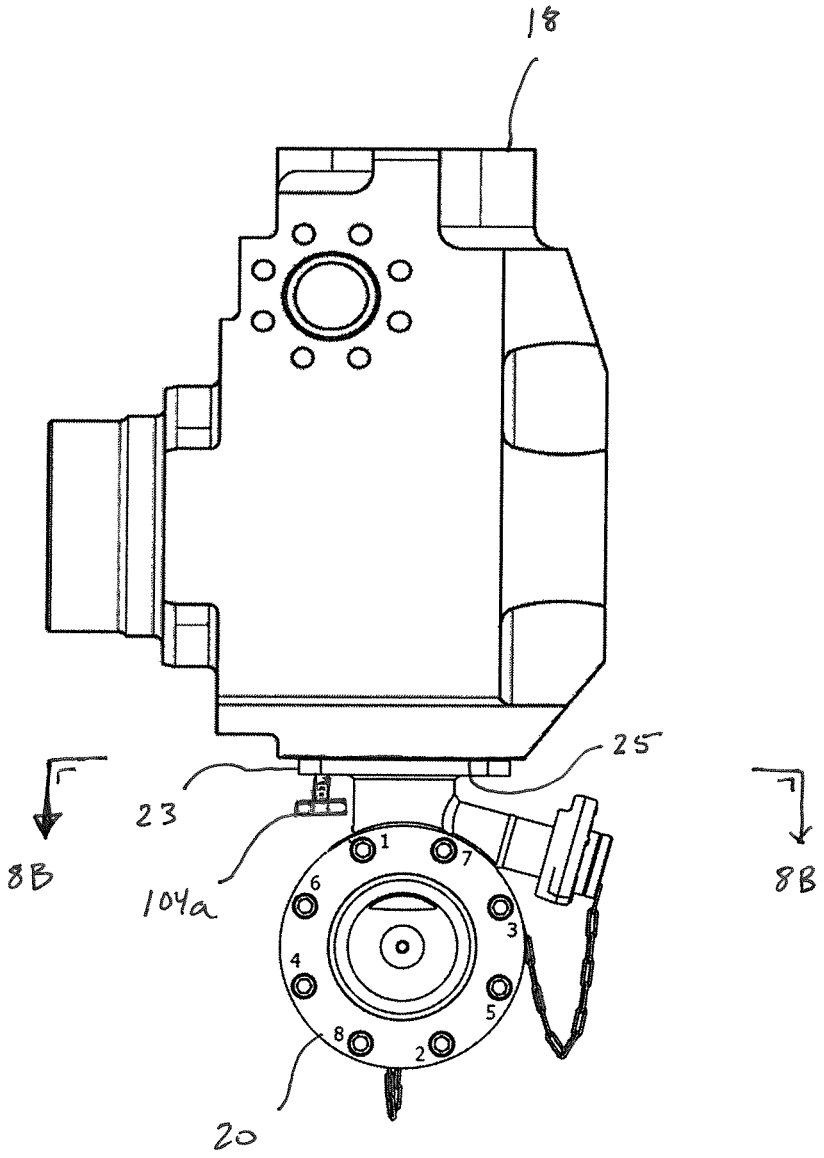
FIG. 8A is another side elevational view of the inlet manifold of FIGS. 2-5B being connected to the fluid end block of FIG. 6, according to an exemplary embodiment.
Figure 8B:
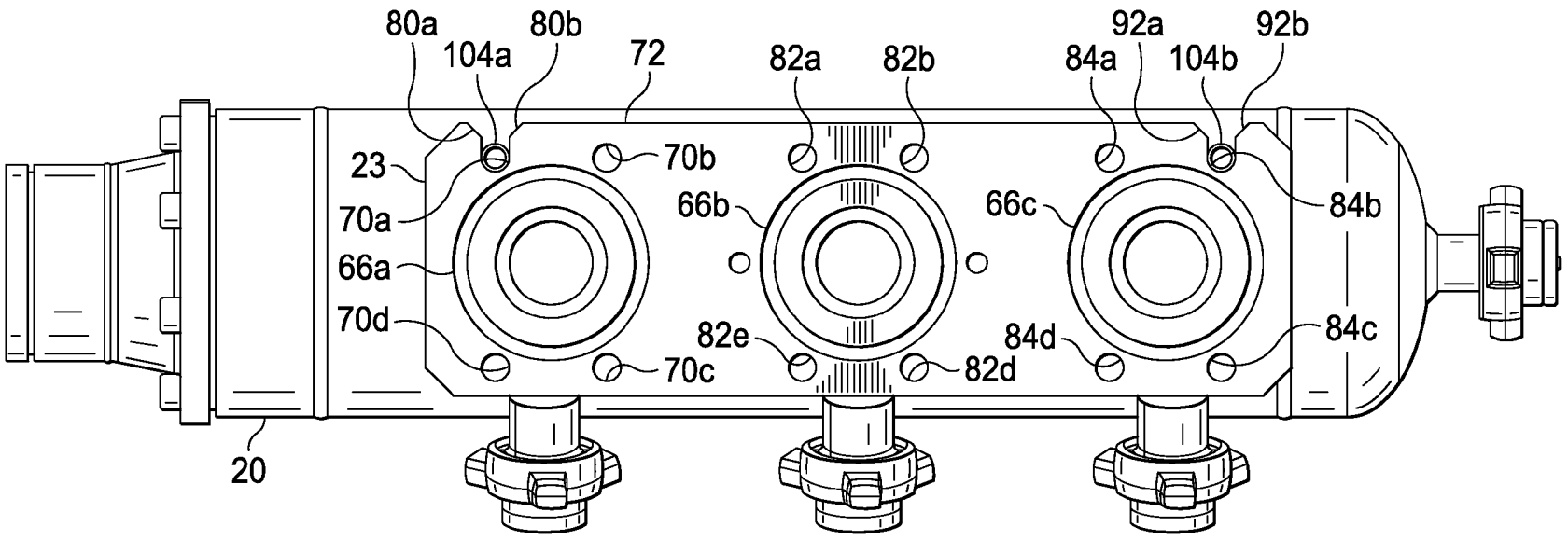
FIG. 8B is a sectional view taken along line 8B-8B of FIG. 8A, according to an exemplary embodiment.

The inlet manifold 20 is translated towards the fluid end block 18, as indicated by the arrow 106 in FIGS. 7A and 7B. In addition to, or instead of, the translation of the inlet manifold 20 in the direction indicated by the arrow 106, the fluid end block 18 is translated towards the inlet manifold 20, as indicated by the arrow 108 in FIGS. 7A and 7B. As the relative translation between the fluid end block 18 and the inlet manifold 20 continues, the inlet manifold 20 and the fluid end block 18 are generally aligned, in a direction parallel to the longitudinal axis 50 of the inlet manifold 20. When so generally aligned, and as the relative translation between the fluid end block 18 and the inlet manifold 20 continues, the threaded portions of the bolts 104*a* and 104*b* pass through the notch portions 74 and 86, respectively, of the through-openings 70*a* and 84*b*. The threaded portions of the bolts 104*a* and 104*b* then pass within the slot portions 76 and 88, respectively, of the through-openings 70*a* and 84*b*, and then into the arcuate portions 78 and 90, respectively, of the through-openings 70*a* and 84*b* until they contact or nearly contact the respective arcuate edges of the mounting plate 23 that are defined by the arcuate portions 78 and 90, as shown in FIGS. 8A and 8B. At this point, the openings 58*a*, 58*b*, and 58*c* of the inlet manifold 20 are generally coaxial or aligned with the openings 94, 96, and 98, respectively, of the fluid end block 18. Further, the arcuate portion 78 of the through-opening 70*a* of the inlet manifold 20 is generally coaxial or aligned with the opening 100*a* of the fluid end block 18. Still further, the through-openings 70*b*-70*d* of the inlet manifold 20 are generally coaxial or aligned with the openings 100*b*-100*d*, respectively, of the fluid end block 18. Yet still further, the through-openings 82*a*, 82*b*, 82*d*, and 82*e* of the inlet manifold 20 are generally coaxial or aligned with the openings 102*a*, 102*b*, 102*c*, and 102*d*, respectively, of the fluid end block 18. Yet still further, the openings 84*a*, 84*c*, and 84*d* of the inlet manifold 20 are generally coaxial or aligned with the openings 104*a*, 104*c*, and 104*d*, respectively, of the fluid end block 18. Yet still further, the arcuate portion 90 of the through-opening 84*b* of the inlet manifold 20 is generally coaxial or aligned with the opening 100*b* of the fluid end block 18.

After effecting the foregoing alignments, additional bolts are installed through the openings 70*b*-70*d*, 82*a*, 82*b*, 82*d*, 82*e*, 84*a*, 84*c*, and 84*d* of the mounting plate 23, and threaded into the holes 100*b*-100*d*, 102*a*, 102*b*, 102*c*, 102*d*, 104*a*, 104*c*, and 104*d*, respectively, of the fluid end block 18. In several exemplary embodiments, during the installation of the additional bolts, at least some shifting of the inlet manifold 20 and/or the fluid end block 18 may be required so that the additional bolts can extend through the mounting plate 23 and into the fluid end block 18 in accordance with the foregoing. The bolts 104*a* and 104*b*, as well as the additional bolts, are then fully threadably engaged to normal preloads so that the mounting plate 23 of the inlet manifold 20 mates against the bottom surface 25 of the fluid end block 18 and the respective annular sealing elements extending within the annular grooves 66*a*-66*c* sealingly engage the bottom surface 25 of the fluid end block 18. As a result, the inlet manifold 20 is connected to the fluid end block 18. At this point, the bolts 104*a* and 104*b* extend through the slot portions 76 and 88, respectively, and thus through the mounting plate 23, and the bolts 104*a* and 104*b* extend into the openings 100*a* and 104*b*, respectively, of the fluid end block 18. The bolts 104*a* and 104*b* also extend through the arcuate portions 78 and 90, respectively, which as noted above are generally coaxial or aligned with the openings 100*a* and 104*b*, respectively.

In an exemplary embodiment, the lead-in chamfers 80*a* and/or 80*b* guide the bolt 104*a* as it passes through the notch portion 74 of the through-opening 70*a* and into the slot portion 76, allowing for a slight misalignment of the mounting plate 23 relative to the fluid end block 18. In particular, during the relative movement between the inlet manifold 20 and the fluid end block 18, the bolt 104*a* may contact and slide along the chamfers 80*a* and/or 80*b* until the bolt 104*a* is disposed in the slot portion 76. Likewise, in an exemplary embodiment, the lead-in chamfers 92*a* and/or 92*b* guide the bolt 104*b* as it passes through the notch portion 86 of the through-opening 84*b* and into the slot portion 88, allowing for a slight misalignment of the mounting plate 23 relative to the fluid end block 18. In particular, during the relative movement between the inlet manifold 20 and the fluid end block 18, the bolt 104*b* may contact and slide along the chamfers 92*a* and/or 92*b* until the bolt 104*b* is disposed in the slot portion 88. Although in several exemplary embodiments one or more of the chamfers 80*a*, 80*b*, 92*a*, and 92*b* may be omitted, in several exemplary embodiments one or more of the chamfers 80*a*, 80*b*, 92*a*, and 92*b* make it easier to align the inlet manifold 20 with the fluid end block 18.

In several exemplary embodiments, the through-openings 70*a* and 84*b*, including the slot portions 76 and 88, are part of the mounting-hole bolt pattern for the mounting plate 23 of the inlet manifold 20. Each of the through-openings 70*a* and 84*b*, and thus each of the slot portions 76 and 88, serves as an installation guide and fastening (or bolting) point, facilitating the connection between the inlet manifold 20 and the fluid end block 18. In several exemplary embodiments, effecting relative translation between the inlet manifold 20 and the bolts 104*a* and 104*b* (and thus the fluid end block 18), until the bolts 104*a* and 104*b* contact or nearly contact the mounting plate 23 and extend through the through-openings 70*a* and 84*b*, respectively, greatly increases the speed in which the mounting-hole bolt pattern of the mounting plate 23 (including the through-openings 70*a*-70*d*, 80*a*, 80*b*, 80*d*, 80*e*, and 84*a*-84*d*) is aligned with the mounting-hole bolt pattern in the bottom surface 25 of the fluid end block 18 (including the openings 100*a*-100*d*, 102*a*-102*d*, and 104*a*-104*d*). As a result, in an exemplary embodiment, the amount of time it takes to connect the inlet manifold 20 to the fluid end block 18 may be decreased. As another result, the amount of labor it takes to connect the inlet manifold 20 to the fluid end block 18 may be decreased. As yet another result, in an exemplary embodiment, the connection between the inlet manifold 20 and the fluid end block 18 is improved.

In an exemplary embodiment, in addition to, or instead of the through-openings 70*a* and 84*b*, one or more of the through-openings 70*b*, 82*a*, 82*b*, and 84*a* may be in the form of a notch and/or include one or more of the following: a notch portion similar to the notch portion 74 and formed in the edge 72 of the mounting plate 23; a slot portion that is similar to the slot portion 76; and an arcuate portion that is similar to the arcuate portion 78.

In an exemplary embodiment, in addition to, or instead of the through-openings 70*a* and 84*b*, one or more of the through-openings 70*c*, 70*d*, 82*d*, 82*e*, 84*c*, and 84*d* may be in the form of a notch and/or include one or more of the following: a notch portion similar to the notch portion 74 and formed in the edge of the mounting plate 23 that is spaced in a parallel relation from the edge 72; a slot portion that is similar to the slot portion 76; and an arcuate portion that is similar to the arcuate portion 78. As a result, in an exemplary embodiment, during the connection of the inlet manifold 20 to the fluid end block 18, the inlet manifold 20 may move in the direction indicated by the arrow 108, and/or the fluid end block 18 may move in the direction indicated by the arrow 106.

In an exemplary embodiment, instead of the through-opening 70*a* including the notch portion 74, the through-opening 70*a* is in the form of a notch and/or includes one or more of the following: a notch portion similar to the notch portion 74 but formed in the edge of the mounting plate 23 that is perpendicular to the edge 72 and proximate the opening 58*a*; a slot portion that is similar to the slot portion 76; and an arcuate portion that is similar to the arcuate portion 78. Additionally, the through-opening 70*d* is in the form of a notch and/or includes one or more of the following: a notch portion similar to the notch portion 74 but formed in the edge of the mounting plate 23 that is perpendicular to the edge 72 and proximate the opening 58*a*; a slot portion that is similar to the slot portion 76; and an arcuate portion that is similar to the arcuate portion 78. As a result, in an exemplary embodiment, during the connection of the inlet manifold 20 to the fluid end block 18, the inlet manifold 20 and/or the fluid end block 18 may move in a direction that is perpendicular to the directions indicated by the arrows 106 and 108.

In an exemplary embodiment, instead of the through-opening 84*b* including the notch portion 86, the through-opening 84*b* is in the form of a notch and/or includes one or more of the following: a notch portion similar to the notch portion 86 but formed in the edge of the mounting plate 23 that is perpendicular to the edge 72 and proximate the opening 58*c*; a slot portion that is similar to the slot portion 88; and an arcuate portion that is similar to the arcuate portion 90. Additionally, the through-opening 84*c* is in the form of a notch and/or includes one or more of the following: a notch portion similar to the notch portion 86 but formed in the edge of the mounting plate 23 that is perpendicular to the edge 72 and proximate the opening 58*c*; a slot portion that is similar to the slot portion 88; and an arcuate portion that is similar to the arcuate portion 90. As a result, in an exemplary embodiment, during the connection of the inlet manifold 20 to the fluid end block 18, the inlet manifold 20 and/or the fluid end block 18 may move in a direction that is perpendicular to the directions indicated by the arrows 106 and 108.

In several exemplary embodiments, two or more of the through-openings 70*a*-70*d*, 82*a*, 82*b*, 82*d*, 82*e*, and 84*a*-84*d* may be in the form of a notch and/or may include one or more of the following: a notch portion similar to the notch portion 74 or 86 and formed in one of the edges of the mounting plate 23; a slot portion that is similar to the slot portion 76 or 88; and an arcuate portion that is similar to the arcuate portion 78 or 90.

In several exemplary embodiments, the mounting plate 23 may be part of a manifold that is different from the inlet manifold 20.

In several exemplary embodiments, instead of the inlet manifold 20 or another type of manifold, the mounting plate 23 may be part of a different component that has a mounting-hole bolt pattern and is configured to be connected to another component that has a corresponding mounting-hole bolt pattern.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A fluid end portion of a reciprocating pump assembly, the fluid end portion being adapted to be operably coupled to a power end portion of the reciprocating pump assembly, the fluid end portion comprising:

a fluid end block comprising a bottom surface and a first plurality of openings formed in the bottom surface;

an inlet manifold connected to the fluid end block, the inlet manifold comprising a mounting plate mated against the bottom surface of the fluid end block, the mounting plate comprising a second plurality of openings formed therethrough and generally aligned with the first plurality of openings, respectively, wherein a first opening in the second plurality of openings comprises a first slot portion to facilitate the connection between the inlet manifold and the fluid end block; and a plurality of fasteners connecting the inlet manifold to the fluid end block, each of the fasteners extending:

through a respective one of the openings in the second plurality of openings and thus through the mounting plate, and into a respective one of the openings in the first plurality of openings;

wherein a first fastener in the plurality of fasteners extends through the first slot portion of the first opening in the second plurality of openings.

2. The fluid end portion of claim 1, wherein the first opening further comprises a first arcuate portion through which the first fastener extends.

3. The fluid end portion of claim 2, wherein the first arcuate portion is part of the first slot portion.

4. The fluid end portion of claim 2, wherein the first opening further comprises a first notch portion formed in an edge of the mounting plate; and wherein the first slot portion extends from the first notch portion to the first arcuate portion.

5. The fluid end portion of claim 4, wherein a second opening in the first plurality of openings comprises: a second notch portion formed in the edge of the mounting plate, a second slot portion extending from the second notch portion, and a second arcuate portion to which the second slot portion extends; and wherein a second fastener in the plurality of fasteners extends through the second slot portion and the second arcuate portion of the second opening in the second plurality of openings.

6. The fluid end portion of claim 4, wherein the mounting plate comprises opposing lead-in chamfers adapted to guide the first fastener into the first slot portion, the opposing lead-in chamfers being defined by the first notch portion of the first opening.

7. The fluid end portion of claim 1, wherein the first opening further comprises a first notch portion formed in an edge of the mounting plate; and wherein the first slot portion extends from the first notch portion.

8. The fluid end portion of claim 1, wherein the first fastener is adapted to pass within the first slot portion during relative movement between the inlet manifold and the fluid end block.

9. A method of connecting an inlet manifold to a fluid end block of a reciprocating pump assembly, the method comprising:

inserting first and second fasteners into respective openings in a first plurality of openings formed in the fluid end block;

effecting relative movement between the inlet manifold and the fluid end block so that the first and second fasteners pass within first and second slot portions, respectively, formed through a mounting plate of the inlet manifold;

continuing to effect relative movement between the inlet manifold and the fluid end block so that the first and second fasteners pass within the first and second slot portions, respectively, until a second plurality of openings formed through the mounting plate are generally aligned with the first plurality of openings formed in the fluid end block, wherein first and second openings in the second plurality of openings comprise the first and second slot portions, respectively; and connecting the inlet manifold to the fluid end block using at least the first and second fasteners.

10. The method of claim 9, wherein effecting relative movement between the inlet manifold and the fluid end block so that the first and second fasteners pass within the first and second slot portions, respectively, comprises:

passing the first and second fasteners through first and second notch portions formed in an edge of the mounting plate, wherein the first and second slot portions extend from the first and second notch portions, respectively.

11. The method of claim 10, wherein the first and second notch portions define first and second pairs of opposing lead-in chamfers, respectively;

wherein, during the relative movement between the inlet manifold and the fluid end block, the first and second pairs of opposing lead-in chamfers are adapted to guide the first and second fasteners, respectively, to the first and second slot portions, respectively.

12. The method of claim 11, wherein the second plurality of openings are generally aligned with the first plurality of openings formed in the fluid end block when the first and second fasteners contact or nearly contact first and second arcuate edges of the mounting plate, and wherein the first and second arcuate edges are defined by first and second arcuate portions, respectively, which are formed through the mounting plate.

13. The method of claim 12, wherein the first and second arcuate portions are part of the first and second slot portions, respectively.

14. The method of claim 12, wherein the first and second slot portions extend to the first and second arcuate portions, respectively.

15. The method of claim 9, further comprising:

inserting additional fasteners through respective openings in the second plurality of openings and into respective openings in the first plurality of openings that are generally aligned therewith;

wherein connecting the inlet manifold to the fluid end block using at least the first and second fasteners comprises connecting the inlet manifold to the fluid end block using at least the first fastener, the second fastener, and the additional fasteners.

16. A manifold adapted to be connected to a fluid end block of a reciprocating pump assembly, the fluid end block comprising a first plurality of openings formed therein, the manifold comprising:

an elongated member defining a fluid passage; and a mounting plate connected to the elongated member, the mounting plate comprising a second plurality of openings formed therethrough and adapted to be generally aligned with the first plurality of openings, respectively, to connect the manifold to the fluid end block;

wherein the second plurality of openings comprises first and second openings, the first and second openings comprising first and second slot portions, respectively, the first and second slot portions being spaced in a parallel relation.

17. The manifold of claim 16, wherein the first and second openings further comprise first and second notch portions, respectively, which are formed in an edge of the mounting plate and from which the first and second slot portions extend, respectively.

18. The manifold of claim 17, wherein the first and second notch portions define first and second pairs of opposing lead-in chamfers, respectively.

19. The manifold of claim 16, wherein the first and second openings further comprise first and second arcuate portions, respectively; and wherein the first and second arcuate portions are adapted to be generally aligned with respective openings in the first plurality of openings to connect the manifold to the fluid end block.

20. The manifold of claim 19, wherein the first and second arcuate portions are part of the first and second slot portions, respectively.

21. The manifold of claim 19, wherein the first and second slot portions extend to the first and second arcuate portions, respectively.

* * * * *